US007277092B2

(12) United States Patent
Shen et al.

(10) Patent No.: US 7,277,092 B2
(45) Date of Patent: Oct. 2, 2007

(54) METHOD AND DEVICE FOR DRIVING LIQUID CRYSTAL DISPLAY

(75) Inventors: Yuh-Ren Shen, Tai-Nan (TW); Cheng-Jung Chen, Chu-Nan County (TW)

(73) Assignee: VastView Technology Inc., Hsinchu (TW)

( * ) Notice: Subject to any disclaimer, the term of this patent is extended or adjusted under 35 U.S.C. 154(b) by 647 days.

(21) Appl. No.: 10/841,033

(22) Filed: Aug. 30, 2004

(65) Prior Publication Data

US 2006/0038761 A1 Feb. 23, 2006

(30) Foreign Application Priority Data

Feb. 17, 2004 (TW) ..... 93103826 A

(51) Int. Cl.
*G09G 5/10* (2006.01)

(52) U.S. Cl. ..... 345/204; 345/77; 345/87; 345/90; 345/94; 345/208; 345/690

(58) Field of Classification Search ..... 345/77, 345/87, 90, 94, 204, 208, 690
See application file for complete search history.

(56) References Cited

U.S. PATENT DOCUMENTS

2003/0222836 A1* 12/2003 Wong ..... 345/87
2004/0140985 A1* 7/2004 Liaw ..... 345/690
2004/0252272 A1* 12/2004 Takatori et al. ..... 349/179

* cited by examiner

*Primary Examiner*—Bipin Shalwala
*Assistant Examiner*—Vincent E. Kovalick

(57) ABSTRACT

A method and device for overdriving a liquid crystal display is provided, which overcomes the limitations and disadvantages of prior arts. The invention can reduce the optical response time of liquid crystal to the driving voltage so that dynamic images can be displayed with superior quality. To achieve the objective of accelerating liquid crystal optical response, the basic pixel structure of the overdrive device provided by the invention contains a first gate line, a second gate line, a first data line, a second data line, a first capacitor, a second capacitor, an output line, a first transistor, and a second transistor. The first transistor has its gate connected to the first gate line, its source connected to the first data line, and its drain connected to the output line, the first capacitor, and the second transistor's drain. The second transistor has its gate connected to the second gate line, its source connected to the second data line, and its drain connected to the output line, the second capacitor, and the first transistor's drain. The first and second capacitors are also connected to the ground. The output line delivers the driving voltage to the corresponding pixel of the LCD display. The first and second gate lines are connected to a gate driver. The first and second data lines are connected to a data driver. The invention also provides a method for overdriving a liquid crystal display.

15 Claims, 11 Drawing Sheets

Frame: N-1
N
N+1
N+2
Code from32 to 120
Code 200(V1)
Code 120(V2)
Code 120 (V2)
(a)
(b)
(c)
$V_{LC}$
Code 32 (V0')
Code 120(V2')
Point time:
A1
A2
A3
A4
A5
A6
n
G1
G1'
D1
D1'
Code200
Code 120
Code 32
Time Frame: N-1
N
N+1
N+2
Code from32 to 120
Code 200(V1)
Code 120(V2)
Code 120
V2
VLC
Code 32 (V0')
(V2')
Point time:
A1
A2
A3
A4
A5
A6
G1
G1'
n
D
D'
Code200
D1
Code 32
D1'
Time Frame: N-1
N
N+1
N+2
Code from32 to 120
VLC
Code 200 (V1)
Code 120 (V2)
Code 120 (V2')
Code 120 (V2)
Code 32 (V0')
(a)
(b)
(c)
Point time:
A1
A2
A3
A4
A5
A6
G1
m
N
Gm
Hsync
D1
Code 200
Code 32
Code 120
Code 120
Time Time
N+2
N+1
N
Frame: N-1
Code from32 to 120
VLC
Code 200(V1)
(a)
(b)
(c)
Code 120(V2)
Code 32 (V0')
Code 120(V2')
Point time:
A1
A2
A3
A4
A5
A6
G1
Gm+1
G2m+1
m
Hsync
Code 200
Code 32
Code 120
D1

Time
N+2
N+1
N
Frame: N-1
Code from32 to 120
VLC
Code 200(V1)
Code 120(V2)
Code 120(V2')
Code 32 (V0')
(a)
(b)
(c)
Point time:
A1
A2
A3
A4
A5
A6
m
G1
Gm+1
G2m+1
Hsync
Code 200
Code 120
Code 32
D1

METHOD AND DEVICE FOR DRIVING LIQUID CRYSTAL DISPLAY

BACKGROUND OF THE INVENTION

1. Field of the Invention

The present invention generally relates to the liquid crystal display, and more specifically to a device and method for driving the liquid crystal display.

2. The Prior Arts

A liquid crystal display (LCD), due to its small form factor, low power consumption, and low heat dissipation, has been widely utilized on various electronic devices. Especially, as the LCD technology has advanced to surpass the limitations and disadvantages of conventional or other existing display technologies such as cathode ray tube (CRT) and light emitting diode (LED), the LCD has been considered to have great importance and potential for the future development of computers, mobile handsets, and other consumer electronic devices.

Generally, an LCD is made by two glass substrates with specially processed surfaces and liquid crystal molecules interposed therebetween. When applying different voltages on the electrodes of the glass substrates, the orientation, and therefore the transparency, of the liquid crystal molecules would vary accordingly. Because the liquid crystal molecules do not illuminate by themselves, a kind of backlight has to be employed. As the light radiated from the backlight passes through the liquid crystal molecules with different transparency, an image is thereby displayed.

More specifically, the structure and function of a thin-film transistor (TFT) LCD is described as follows. In general, a TFT LCD is a layer of liquid crystal interposed between two glass substrates. Color filters are installed on one of the glass substrates and transistors are built into the other glass substrate. The transistors function as switches and control the voltages applied on the liquid crystal molecules. When the transistors are turned on and voltages are applied, the liquid crystal molecules will have corresponding orientations and transparencies. Each pixel of the LCD display therefore has a specific brightness. The color filters attached to the glass substrate give each pixel the three colors red, green, and blue. These pixels exhibiting the colors red, green, and blue constitute the image displayed on the LCD.

As mentioned earlier, the LCD technology has advantages that are not available from the conventional CRT and existing LED display technologies. The LCD display, however, does have its own limitations. As mentioned earlier, under the influence of the electric fields established by the voltages applied on the electrodes of the glass substrates, the liquid crystal molecules develop corresponding orientations and therefore a texture is formed. Then, by the lights radiate from the backlight module installed behind the glass substrate, the pixels of the LCD display manifest various degrees of brightness and an image is thereby displayed. During this process, the applied voltages can reach their target values instantaneously. The liquid crystal molecules, however, require a period of time to develop the targeted orientations. The change of brightness of pixels therefore lags behind the change of voltages, causing a so-called delay phenomenon. As shown in FIG. 1, the applied voltage reaches its targeted value (referred to as targeted code in FIG. 1) almost instantaneously but the brightness of the pixel follows the smooth dotted curve. This delay phenomenon seriously affects the display quality of fast changing, dynamic images on a LCD display.

Conventionally, to overcome such delay phenomenon, an overdrive method is applied whose device structure is shown in FIG. 2. The device contains series-connected transistor and capacitors to form a controller in controlling the voltage level applied on the liquid crystal molecule. Then a higher voltage is applied so that the liquid crystal molecule can reach its targeted optical response faster. The LCD therefore has a faster response time so that the requirement for displaying fast changing, dynamic images can be fulfilled.

To further explain the overdrive method, please refer to FIG. 3. FIG. 3(*a*) is a characteristic graph showing the optical response of a LCD pixel (near the intersection of the gate line G1 and the data line D1 as shown in FIG. 2) driven by the overdrive device according to a prior art. The unit of the voltage in the following description is referred to as code. A code could be a μV ($10^{-6}$ V) or other similar voltage unit. Assuming that, to make the LCD pixel to reach its targeted brightness, the targeted driving voltage applied to the LCD pixel is code 128, the optical response of the LCD pixel is depicted as the dotted curve (a). To accelerate the optical response speed of the LCD pixel, conventional overdrive methods use a "coaxing" approach. FIG. 3(*b*) is a waveform diagram showing the pulse waveform of the control voltage asserted by the overdrive device according to a prior art on the gate line G1 (shown in FIG. 2). FIG. 3(*c*) is a waveform diagram showing the pulse waveform of the driving voltage asserted by the overdrive device according to a prior art on the data line D1 (shown in FIG. 2). At the pulses of the control voltage, the corresponding driving voltage is applied on the LCD pixel. As shown in FIGS. 3(*b*) and 3(*c*), a higher driving voltage code 200 is applied first so that the optical response of the pixel follows an acuter dotted curve (b) to reach the targeted brightness faster than the dotted curve (a). Then the driving voltage is adjusted to code 128 so that the pixel maintains its targeted brightness. Please note that, for the foregoing overdrive method according to a prior art, the period of the control voltage is the same as the frame time. For example, if the frame rate of the LCD display is 60 Hz, the frame time and the control voltage period are both 16.7 ms. In other words, the application of the next control voltage pulse and therefore the next driving voltage can only be applied in the next frame time. The optical response time of the LCD pixel therefore cannot be shortened to be within a single frame time. This is the major limitation of the overdrive method according to a prior art.

Accordingly, the present invention is aimed at overcoming the limitations and disadvantages of the LCD overdriving methods according to prior arts.

SUMMARY OF THE INVENTION

The present invention provides a method and device for overdriving a LCD display to effectively achieve faster optical response time so that fast changing; dynamic images can be displayed with superior quality.

The basic pixel structure of the overdrive device provided by the present invention contains a first gate line, a second gate line, a first data line, a second data line, a first capacitor, a second capacitor, an output line, a first transistor, and a second transistor. The first transistor has its gate connected to the first gate line, its source connected to the first data line, and its drain connected to the output line, the first capacitor, and the second transistor's drain. The second transistor has its gate connected to the second gate line, its source connected to the second data line, and its drain connected to the output line, the second capacitor, and the first transistor's drain. The first and second capacitors are also connected to the ground. The output line delivers the driving voltage to the corresponding pixel of the LCD display. The first and second gate lines are connected to a gate driver. The first and second data lines are connected to a data driver.

The present invention also provides a method for overdriving a liquid crystal display.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

FIG. 3(*b*) is a waveform diagram showing the pulse waveform of the control voltage asserted by the overdrive device according to a prior art.

FIG. 3(*c*) is a waveform diagram showing the pulse waveform of the driving voltage asserted by the overdrive device according to a prior art.

DETAILED DESCRIPTION OF THE PREFERRED EMBODIMENTS

Preferred embodiments of the present invention will be described along with the accompanying drawings in the following. In the accompanying drawings, identical reference numbers are used to refer to the same elements of the embodiments of the present invention. Waveform diagrams are mainly used in the following to describe the driving voltage applied on liquid crystal and the corresponding trajectory and behavior of optical response of liquid crystal. Through these waveform diagrams, the features and advantages of the present invention are thereby manifested.

Figure 1:
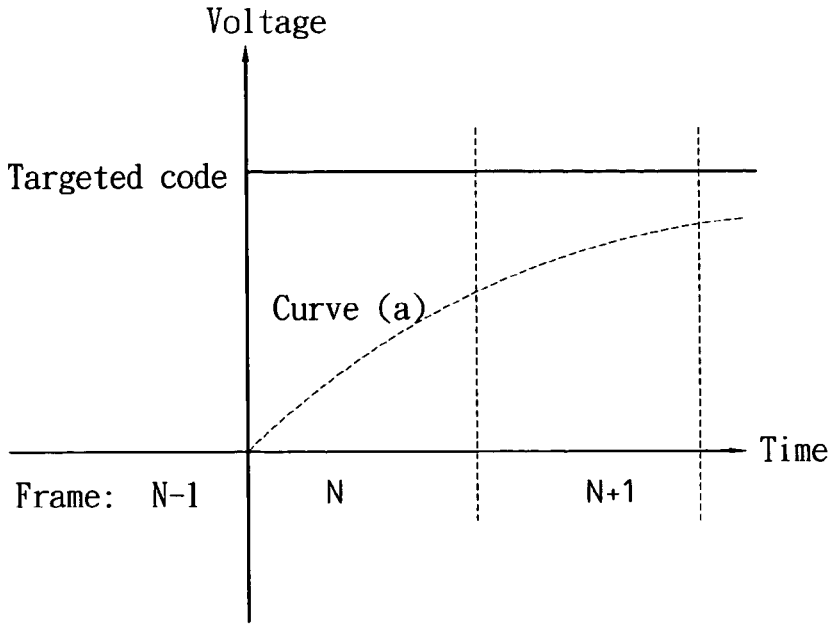
FIG. 1 is a characteristic graph showing the optical response of an LCD pixel under the application of a driving voltage.
Figure 2:
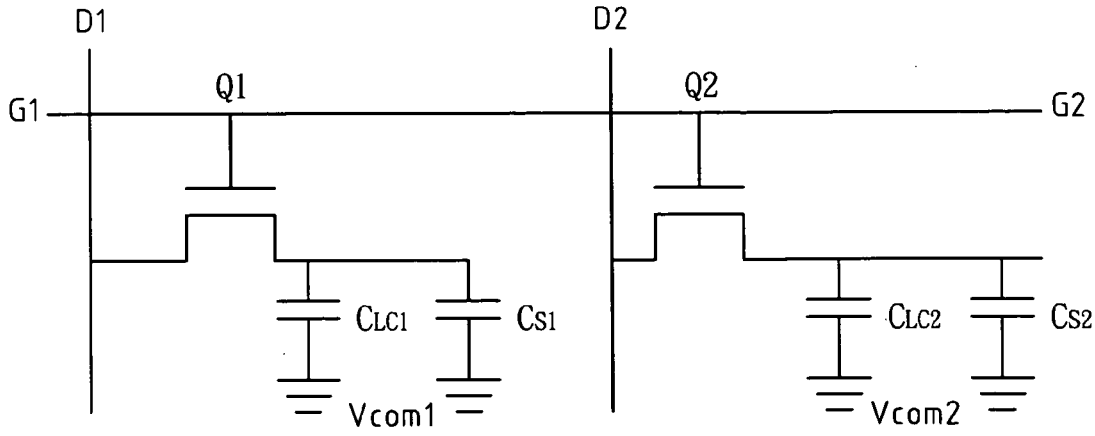
FIG. 2 is a schematic diagram showing the conventional overdrive device according to a prior art.
Figures 3A, 3B, 3C:
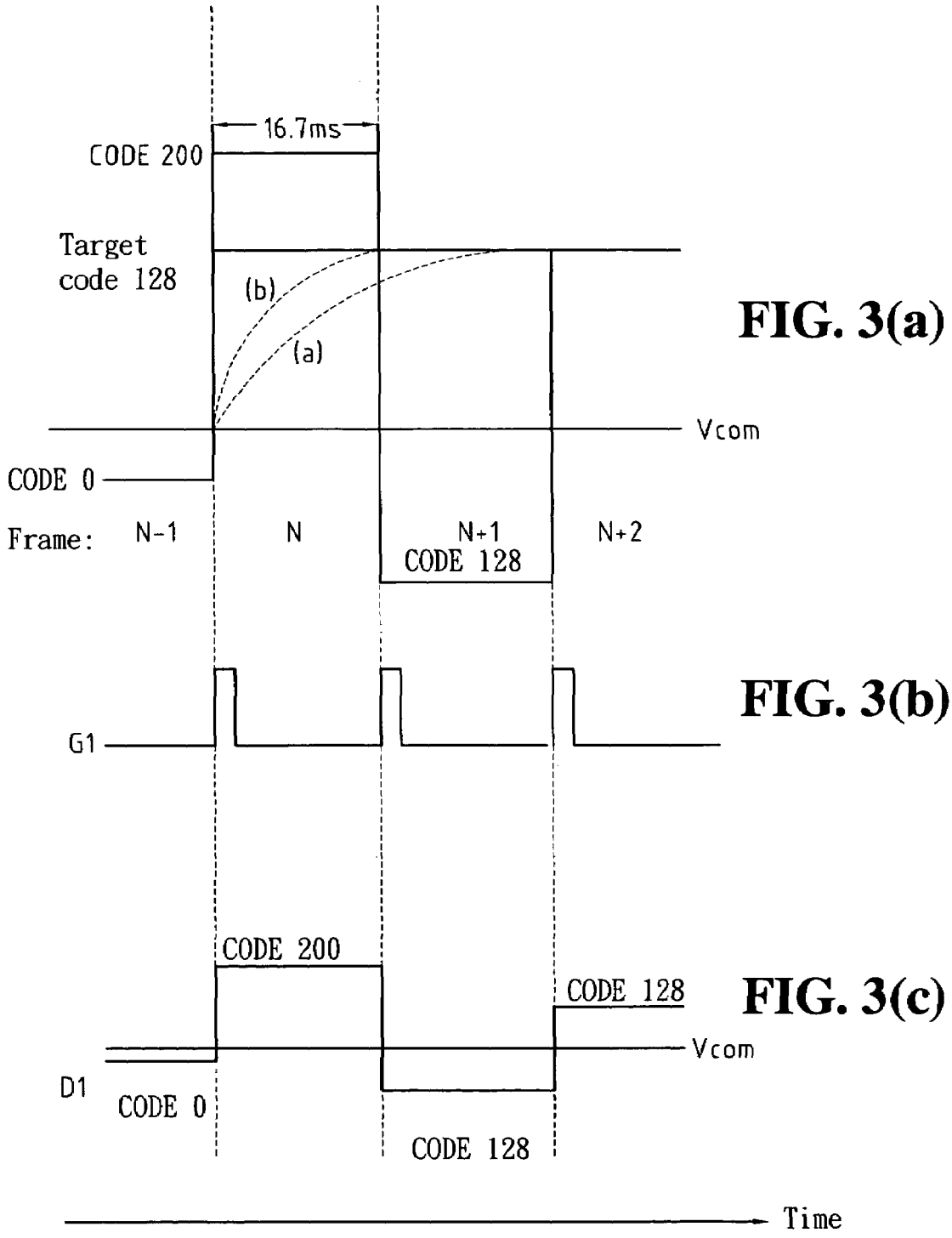
FIG. 3(*a*) is a characteristic graph showing the optical response of an LCD pixel driven by the overdrive device according to a prior art.

Referring to FIG. 3, within FIGS. 3(*a*) through 3(*c*), the horizontal axis is the time measured in milli-second (ms) and the vertical axis is the voltage measured in a unit referred to as code. To simply the comparison between the figures, a single horizontal time axis is plotted beneath FIG. 3(*c*) and, to facilitate the explanation of the present invention, the horizontal time axis is partitioned into periods, each represents the time required to shows the frame N−1, N, and N+1 respectively on the LCD display. The waveform in FIG. 3(*b*) shows the control voltage pulses asserted on the gate line G1 (shown in FIG. 2). The waveform of FIG. 3(*c*) shows the driving voltage pulses asserted on the data line D1 (shown in FIG. 2). FIG. 3(*a*) then shows output voltage waveform to the pixel near the intersection of the gate line G1 and the data line D1, generated from the two voltages depicted in FIGS. 3(*b*) and 3(*c*). Within FIG. 3(*a*), the curves (a) and (b) show the characteristic curve of optical response of the liquid crystal molecules under different driving voltages respectively. The optical response refers to the luminance presented by the liquid crystal measured in units of nits (cd/m$^2$).

In the following, five embodiments of the present invention along with their respective circuit schematic diagram and various control voltage waveforms, driving voltage waveforms, and optical response characteristics curves are described to explain the method and device provided by the present invention.

First Embodiment of the Present Invention

The first embodiment of the present invention is described in the following along with FIGS. 4(*a*) and 4(*b*) and FIGS. 5(*a*) to 5(*e*).

Figures 4A, 4B:
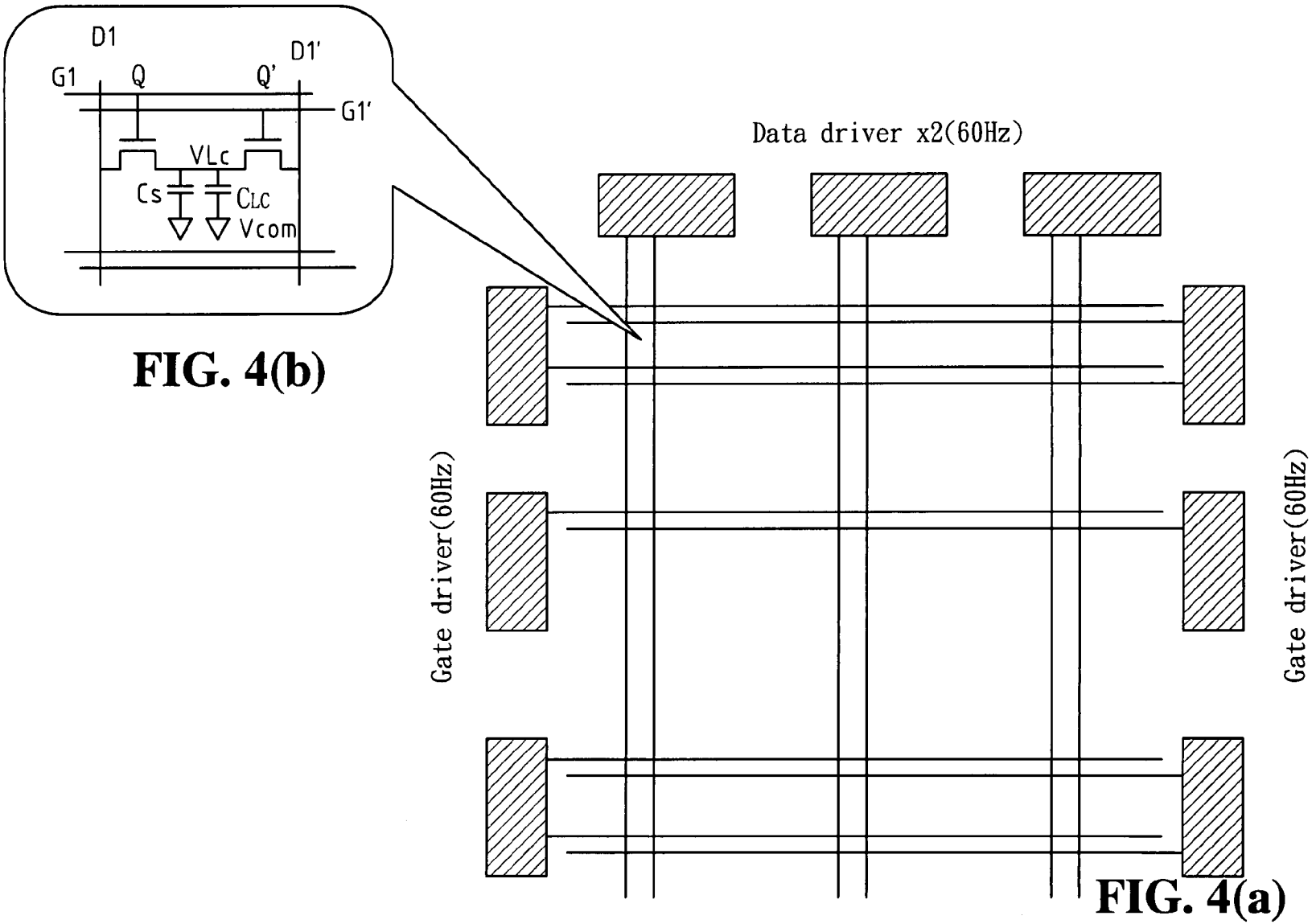
FIGS. 4(*a*) and 4(*b*) are schematic diagrams showing the overdrive device and an inner structure of a pixel at the intersection of a plurality of gate lines and data lines according to the first embodiment of the present invention.

FIGS. 4(*a*) and 4(*b*) are schematic diagrams showing the overdrive device and an inner structure of a pixel at the intersection of a plurality of gate lines and data lines according to the first embodiment of the present invention.

Driving Device of the First Embodiment of the Present Invention

As shown in FIG. 4(*b*), the pixel structure of the overdrive device according to the present invention comprises a firs gate line G1, a second gate line G1', a first data line D1, a second data line D1', a first capacitor Cs connected to the ground as a storage capacitor, a second capacitor $C_{LC}$ also connected to the ground representing the equivalent capacitance of liquid crystal, an output line (not shown in FIG. 4(*b*)) for delivering the output overdrive voltage ($V_{LC}$) to the a corresponding pixel on the LCD display, a first transistor Q having its gate connected to the first gate line G1, its source connected to the first data line D1, and its drain connected to the output line, the first capacitor Cs and the drain of the second transistor Q', a second transistor Q' having its gate connected to the second gate line G1', its source connected to the second data line D1', and its drain connected to the drain of the first transistor Q, the second capacitor $C_{LC}$, and the output line. As shown in FIG. 4(*a*), the first and second gate lines G1 and G1' are connected to a gate driver and the first and second data lines D1 and D1' are connected to a data driver.

Figures 5A, 5B, 5C, 5D, 5E:
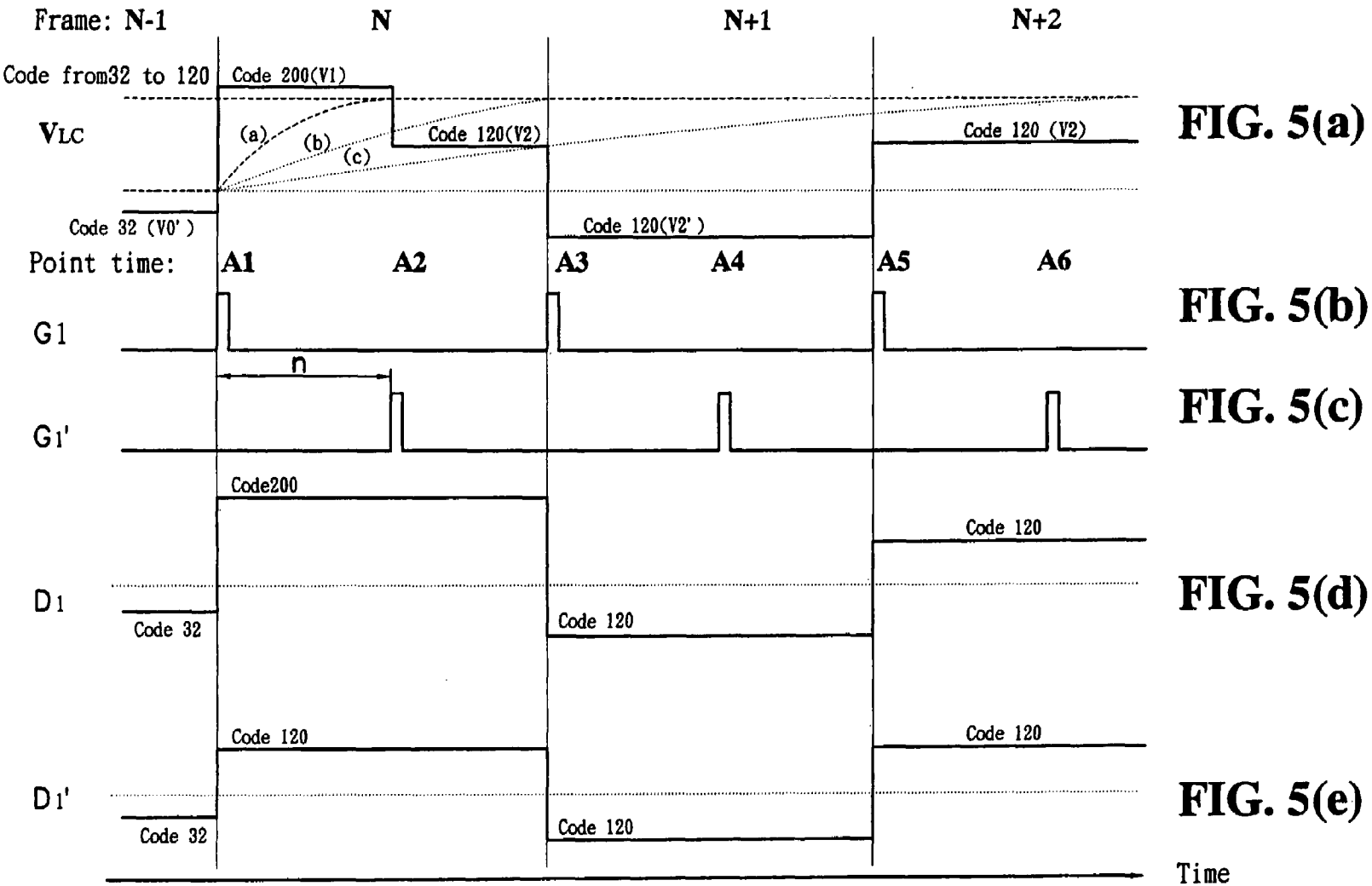
FIGS. 5(*a*) through 5(*e*) shows the various waveforms of the output overdrive voltage $V_{LC}$, the control voltages asserted on the first and second gate lines G1 and G1', the driving voltages applied on the first and second data lines D1 and D1' of FIGS. 4(*a*) and 4(*b*) respectively.

FIGS. 5(*a*) through 5(*e*) show the various waveforms of the output overdrive voltage $V_{LC}$, the control voltages asserted on the first and second gate lines G1 and G1', the driving voltages applied on the first and second data lines D1 and D1' of FIGS. 4(*a*) and 4(*b*) respectively. Please note that the control voltage pulses on the first and second gate lines G1 and G1' have a time difference for scanning (or displaying) n lines of pixels of the LCD display. The time difference between the two control voltages is adjustable according to the present invention.

Please be reminded again that the output overdrive voltage VLC can reach its targeted voltage almost instantaneously but the driven liquid crystal molecules require a period of time to reach the targeted optical response due to a material characteristics of the liquid crystal.

Driving Method of the First Embodiment of the Present Invention

The driving method of the overdrive device according to the first embodiment of the present invention comprises the following steps:

(a) applying a first control voltage G1 having a periodical pulse waveform as shown in FIG. 5(*b*) on the gate of the first transistor Q, (b) applying a second control voltage G1' as shown in FIG. 5(*c*) having an identical periodical pulse waveform but lags behind the first control voltage G1 on the gate of the second transistor Q', (c) applying a first driving voltage D1 as shown in FIG. 5(*d*) on the source of the first transistor Q which delivers the first driving voltage D1 to the output line when the first transistor Q is triggered by the first control voltage G1, (d) applying a second driving voltage D1' as shown in FIG. 5(*e*) on the source of the second transistor Q' which delivers the second driving voltage D1' to the output line when the second transistor Q' is triggered by the second periodical voltage, and (e) delivering the output overdrive voltage $V_{LC}$ formed by the first and second driving voltages D1 and D1' through the output line to a corresponding pixel of the LCD display so that the pixel reaches a targeted optical response.

Waveform Analysis of the First Embodiment of the Present Invention

Because alternating current (AC) voltage is used to drive the overdrive device, the driving voltages generated by the overdrive device as shown in FIGS. 5(*d*) and 5(*e*) and the output overdrive voltage $V_{LC}$ alternate between positive and negative phases with respect to the reference voltage Vcom.

During the frame N−1 and before the instant A1, the driving voltage D1' and the output overdrive voltage $V_{LC}$ are at a negative V0' (code 32). Then after the instant A1 and during frame N, the driving voltage D1 jumps instantaneously to a positive V1 (code 200). Due to the control voltage G1's trigger at the instant A1, the output overdrive voltage $V_{LC}$ jumps to the positive V1 (code 200) and remains at V1 until the instant A2. At the instant A2, the driving voltage D1' is at a positive V2 (code 120). Due to the trigger of the control voltage G1' at the instant A2, the output overdrive voltage $V_{LC}$ drops from the positive V1 (code 200) to the positive V2 (code 120) and remains at V2 until the instant A3. Frame N+1 starts from the instant A3. At this point of time, the driving voltage D1 drops instantaneously to a negative V2' (code 120). Due to the control voltage G1's trigger at the instant A3, the output overdrive voltage $V_{LC}$ drops instantaneously to the negative V2' (code 120) and remains at V2' until the instant A4. At the instant A4, the driving voltage D1' is still at the negative V2' (code 120). Due to the trigger of the control voltage G1' at the instant A4, the output overdrive voltage $V_{LC}$ is maintained at the negative V2' (code 120) until the instant A5. Frame N+2 starts from the instant A5. At this point of time, the driving voltage D1 jumps instantaneously to a positive V2 (code 120). Due to the control voltage G1's trigger at the instant A5, the output overdrive voltage $V_{LC}$ jumps instantaneously to the positive V2 (code 120) as well and remains at V2 until the instant A6. What happens at and after the instant A6 can be easily deduced from the foregoing description.

As shown in FIG. 5(*a*), the curve (c) is the liquid crystal optical response trajectory when no overdrive is applied. The curve (b) is the liquid crystal optical response trajectory under overdrive and the frame time is 16 ms. The curve (a) is the liquid crystal optical response trajectory under overdrive and the frame time is 5 ms.

The n as shown in FIG. 5(*c*) represents n pulses. This means that, within the same frame N, the control voltage pulses of the control voltages G1 and G1' have a time difference of triggering the display of n lines of pixels. More specifically, after the overdrive device applies the control voltage G1 on a first line of pixel, the overdrive device will then apply similar control voltages to a second, third, until a nth line of pixels. Then the overdrive device returns to the first line of pixel and applies the control voltage G1'. This time interval represented by the number n can be adjusted by the designer of the LCD display based on the actual requirement of the display and the material characteristics of the liquid crystal. This technique can also be applied to scanning black lines to achieve an effect similar to the impulse type display such as CRT. This is the most significant feature of the present invention that makes the present invention far superior than the prior arts.

Second Embodiment of the Present Invention

The second embodiment of the present invention is described in the following along with FIGS. 6(*a*) and 6(*b*) and FIGS. 7(*a*) to 7(*g*).

Figures 6A, 6B:
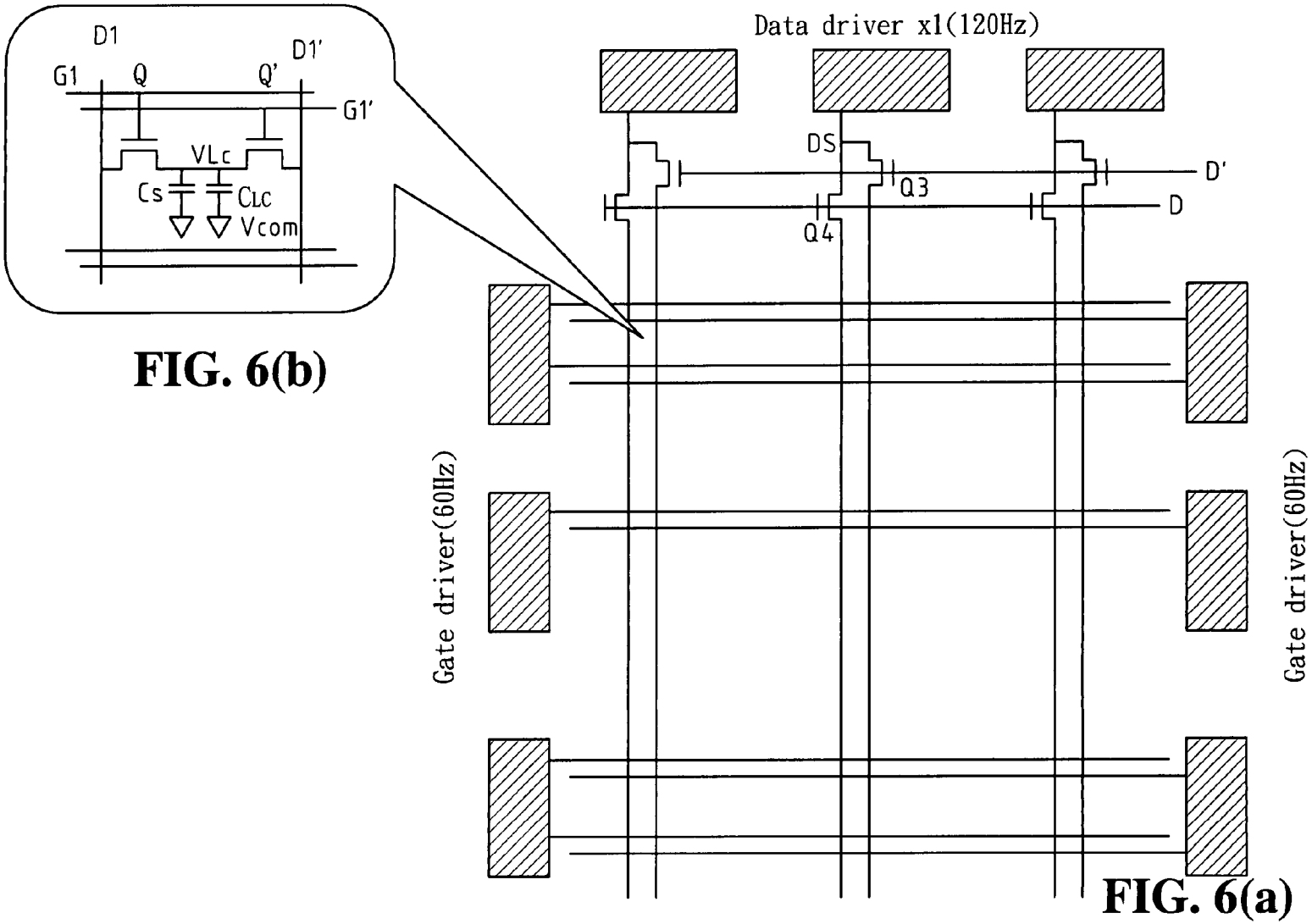
FIGS. 6(*a*) and 6(*b*) are schematic diagrams showing the overdrive device and an inner structure of a pixel at the intersection of a plurality of gate lines and data lines according to the second embodiment of the present invention.

FIGS. 6(*a*) and 6(*b*) are schematic diagrams showing the overdrive device and an inner structure of a pixel at the intersection of a plurality of gate lines and data lines according to the second embodiment of the present invention.

Driving Device of the Second Embodiment of the Present Invention

As shown in FIG. 6(*b*), the pixel structure of the overdrive device according to the present invention comprises a firs gate line G1, a second gate line G1', a first data line D1, a second data line D1', a first capacitor Cs connected to the ground as a storage capacitor, a second capacitor $C_{LC}$ also connected to the ground representing the equivalent capacitance of liquid crystal, an output line (not shown in FIG. 6(*b*)) for delivering the output overdrive voltage ($V_{LC}$) to a corresponding pixel on the LCD display, a first transistor Q having its gate connected to the first gate line G1, its source connected to the first data line D1, and its drain connected to the output line, the first capacitor Cs and the drain of the second transistor Q', a second transistor Q' having its gate connected to the second gate line G1', its source connected to the second data line D1', and its drain connected to the drain of the first transistor Q, the second capacitor $C_{LC}$, and the output line. As shown in FIG. 6(*a*), the first and second gate lines G1 and G1' are connected to a gate driver and the first and second data lines D1 and D1' are connected to the drains of a fourth and third transistor Q4 and Q3 respectively. The fourth and third transistor Q3 and Q4 have their sources parallel connected to a data driver via a fifth data line DS and their gates connected to a third and fourth data lines D' and D respectively.

Figures 7A, 7B, 7C, 7D, 7E, 7F, 7G:
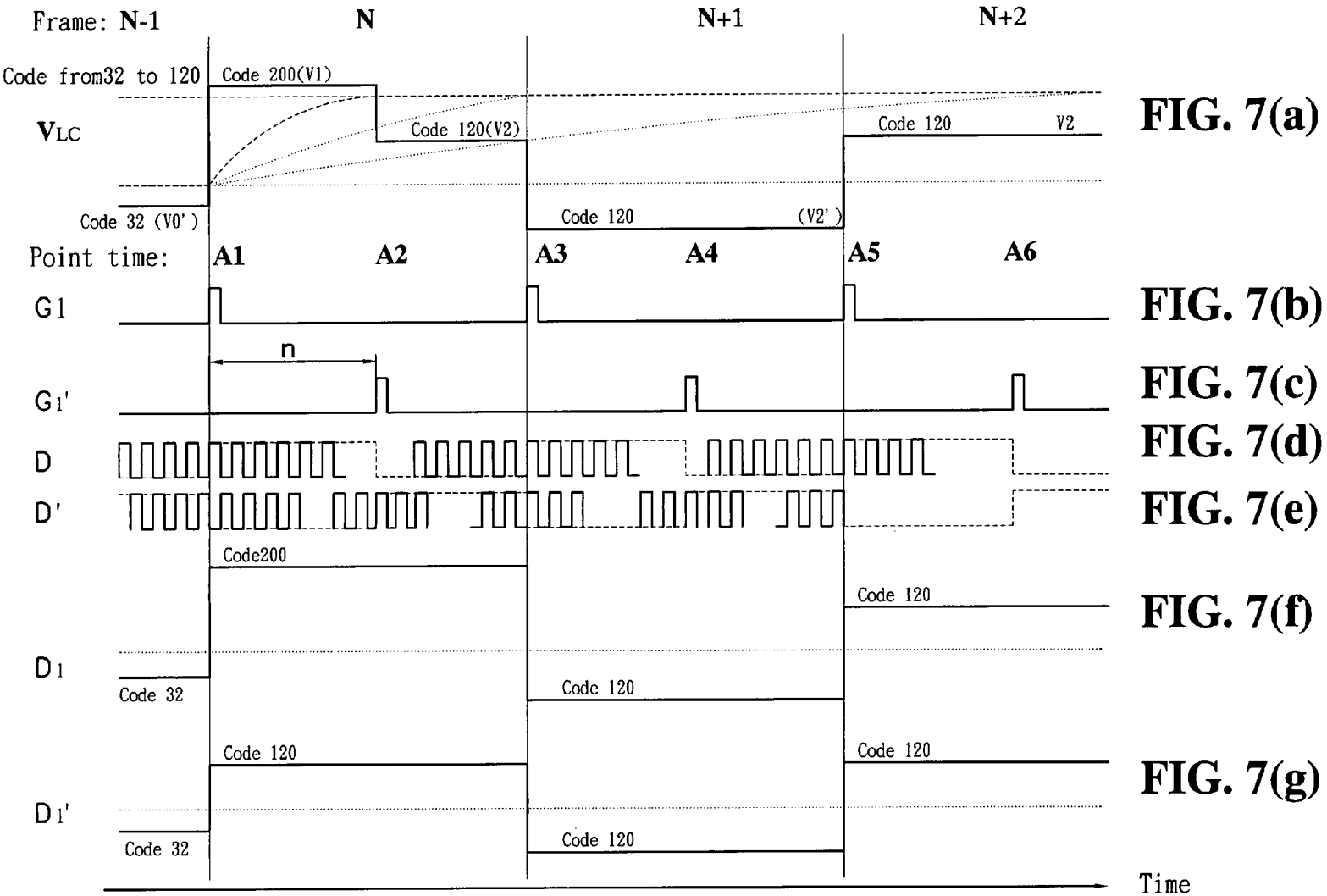
FIGS. 7(*a*) through 7(*g*) shows the various waveforms of the output overdrive voltage $V_{LC}$, the control voltages asserted on the first and second gate lines G1 and G1', the driving voltages applied on the fourth, third, first and second data lines D, D', D1 and D1' of FIGS. 6(*a*) and 6(*b*) respectively.

FIGS. 7(*a*) through 7(*g*) show the various waveforms of the output overdrive voltage $V_{LC}$, the control voltages asserted on the first and second gate lines G1 and G1', the driving voltages applied on the fourth, third, first and second data lines D, D', D1 and D1' of FIGS. 6(*a*) and 6(*b*) respectively. Please note that the control voltage pulses on the first and second gate lines G1 and G1' have a time difference for scanning (or displaying) n lines of pixels of the LCD display. The time difference between the two control voltages is adjustable according to the present invention.

Driving Method of the Second Embodiment of the Present Invention

The driving method of the overdrive device according to the second embodiment of the present invention comprises the following steps:

(a) applying a first control voltage G1 having a periodical pulse waveform as shown in FIG. 7(*b*) on the gate of the first transistor Q, (b) applying a second control voltage G1' as shown in FIG. 7(*c*) having an identical periodical pulse waveform but lags behind the first control voltage G1 on the gate of the second transistor Q', (c) applying a fourth driving voltage D as shown in FIG. 7(*d*) on the gate of the fourth transistor Q4 which, when triggered, generates the first driving voltage D1 (as shown in FIG. 7(*f*)) at the drain of the transistor Q4 and applies the first driving voltage D1 to the source of the first transistor Q which delivers the first driving voltage D1 to the output line when the first transistor Q is triggered by the first control voltage G1, (d) applying a third driving voltage D' as shown in FIG. 7(*e*) on the gate of the third transistor Q3 which, when triggered, generates the second driving voltage D1' (as shown in FIG. 7(*g*)) at the drain of the transistor Q3 and applies the second driving voltage D1' to the source of the second transistor Q' which delivers the second driving voltage D1' to the output line when the second transistor Q' is triggered by the second control voltage G1', and (e) delivering the output overdrive voltage $V_{LC}$ formed by the first and second driving voltages D1 and D1' through the output line to a corresponding pixel of the LCD display so that the pixel reaches a targeted optical response.

Waveform Analysis of the Second Embodiment of the Present Invention

Because alternating current (AC) voltage is used to drive the overdrive device, the driving voltages generated by the overdrive device as shown in FIGS. 7(*f*) and 7(*g*) and the output overdrive voltage $V_{LC}$ alternate between positive and negative phases with respect to the reference voltage Vcom.

During the frame N−1 and before the instant A1, the driving voltage D1' and the output overdrive voltage $V_{LC}$ are at a negative V0' (code 32). Then after the instant A1 and during frame N, the driving voltage D1 jumps instantaneously to a positive V1 (code 200). Due to the control voltage G1's trigger at the instant A1, the output overdrive voltage $V_{LC}$ jumps to the positive V1 (code 200) and remains at V1 until the instant A2. At the instant A2, the driving voltage D1' is at a positive V2 (code 120). Due to the trigger of the control voltage G1' at the instant A2, the output overdrive voltage $V_{LC}$ drops from the positive V1 (code 200) to the positive V2 (code 120) and remains at V2 until the instant A3. Frame N+1 starts from the instant A3. At this point of time, the driving voltage D1 drops instantaneously to a negative V2' (code 120). Due to the control voltage G1's trigger at the instant A3, the output overdrive voltage $V_{LC}$ drops instantaneously to the negative. V2' (code 120) and remains at V2' until the instant A4. At the instant A4, the driving voltage D1' is still at the negative V2' (code 120). Due to the trigger of the control voltage G1' at the instant A4, the output overdrive voltage $V_{LC}$ is maintained at the negative V2' (code 120) until the instant A5. Frame N+2 starts from the instant A5. At this point of time, the driving voltage D1 jumps instantaneously to a positive V2 (code 120). Due to the control voltage G1's trigger at the instant A5, the output overdrive voltage $V_{LC}$ jumps instantaneously to the positive V2 (code 120) as well and remains at V2 until the instant A6. What happens at and after the instant A6 can be easily deduced from the foregoing description.

As shown in FIG. 7(*a*), the curve (c) is the liquid crystal optical response trajectory when no overdrive is applied. The curve (b) is the liquid crystal optical response trajectory under overdrive and the frame time is 16 ms. The curve (a) is the liquid crystal optical response trajectory under overdrive and the frame time is 5 ms.

The n as shown in FIG. 7(*c*) represents n pulses. This means that, within the same frame N, the control voltage pulses of the control voltages G1 and G1' have a time difference of triggering the display of n lines of pixels. More specifically, after the overdrive device applies the control voltage G1 on a first line of pixel, the overdrive device will then apply similar control voltages to a second, third, until a nth line of pixels. Then the overdrive device returns to the first line of pixel and applies the control voltage G1'. This time interval represented by the number n can be adjusted by the designer of the LCD display based on the actual requirement of the display and the material characteristics of the liquid crystal. This is the most significant feature of the present invention that makes the present invention far superior than the prior arts.

The output overdrive voltage $V_{LC}$ generated by the overdrive device according the second embodiment of the present invention is the same as the one generated by the first embodiment of the present invention. This is intended to simply the explanation and comparison of the embodiments of the present invention. The designer, however, can actually, based on the principle of the present invention, to generate the output overdrive voltage $V_{LC}$ having a specific waveform to suit the designer's requirement.

Third Embodiment of the Present Invention

The third embodiment of the present invention is described in the following along with FIGS. 8(*a*) and 8(*b*) and FIGS. 9(*a*) to 9(*d*).

Figures 8A, 8B:
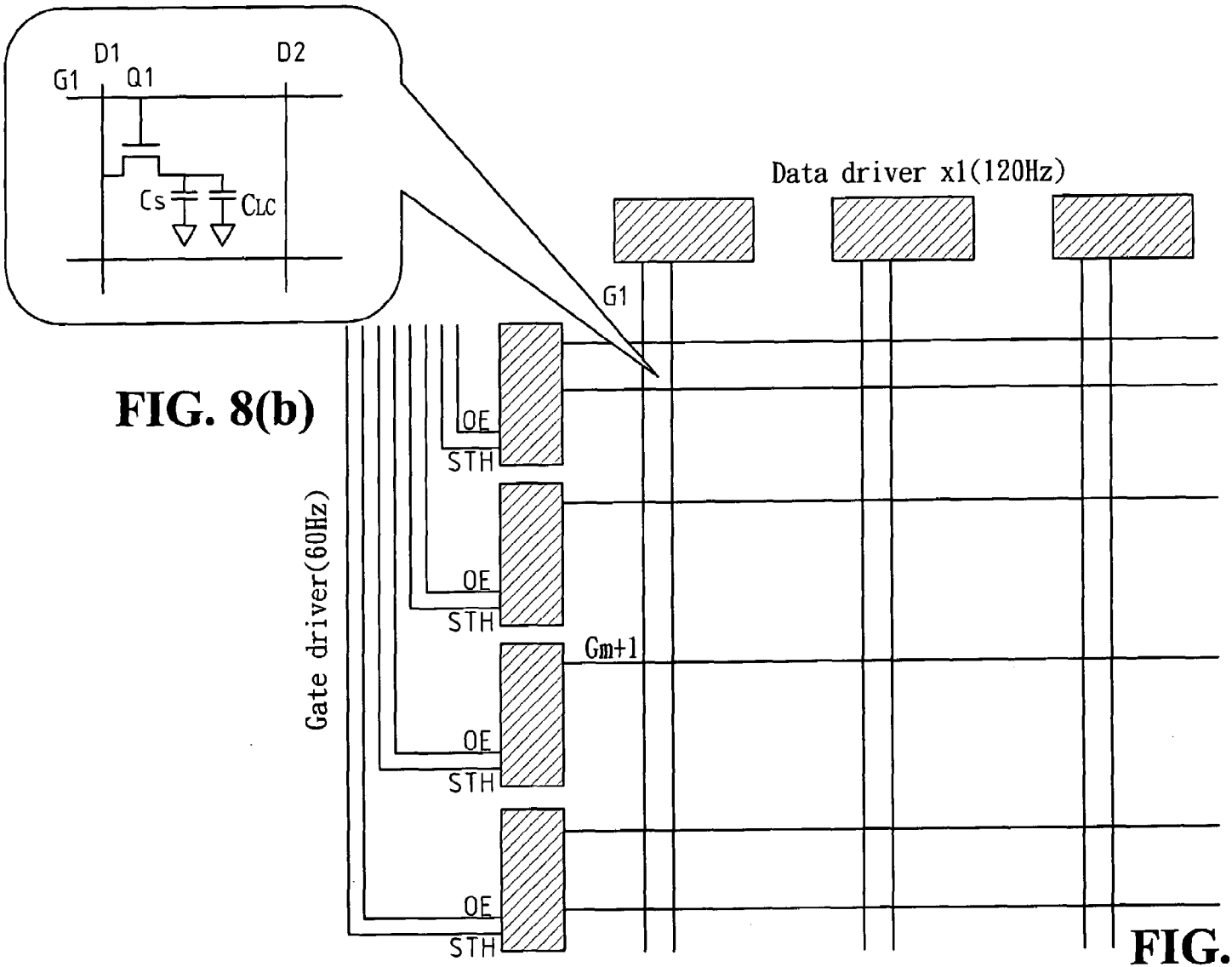
FIGS. 8(*a*) and 8(*b*) are schematic diagrams showing the overdrive device and an inner structure of a pixel at the intersection of a plurality of gate lines and data lines according to the third embodiment of the present invention.

FIGS. 8(*a*) and 8(*b*) are schematic diagrams showing the overdrive device and an inner structure of a pixel at the intersection of a plurality of gate lines and data lines according to the third embodiment of the present invention.

Driving Device of the Third Embodiment of the Present Invention

As shown in FIG. 8(*b*), the pixel structure of the overdrive device according to the present invention comprises a firs gate line G1, a first data line D1, a first capacitor Cs connected to the ground as a storage capacitor, a second capacitor $C_{LC}$ also connected to the ground representing the equivalent capacitance of liquid crystal, an output line (not shown in FIG. 8(*b*)) for delivering the output overdrive voltage ($V_{LC}$) to a corresponding pixel on the LCD display, a first transistor Q1 having its gate connected to the first gate line G1, its source connected to the first data line D1, and its drain connected to the output line, the first capacitor Cs, and the second capacitor $C_{LC}$. Even though not shown in FIGS. 8(*a*) and 8(*b*), another pixel at the intersection of the date line D1 and a second gate line Gm has an identical structure containing a second transistor Qm (not shown in FIGS. 8(*a*) and 8(*b*)). As shown in FIG. 8(*a*), the first gate line G1 is connected to a gate driver and the first data line D1 is connected to a data driver. Each of the gate drivers has two input lines, the Output Enable (OE) and Start Pulse Horizontal (STH) lines. The OE and STH input lines control the gate drivers so that control voltages are asserted on two lines of pixels via two gate lines (such as the first gate line G1 and a second gate line Gm) simultaneously at one time. The two lines of pixels that are m lines of pixels apart therefore display two lines of an image simultaneously on the LCD display.

Figures 9A, 9B, 9C, 9D:
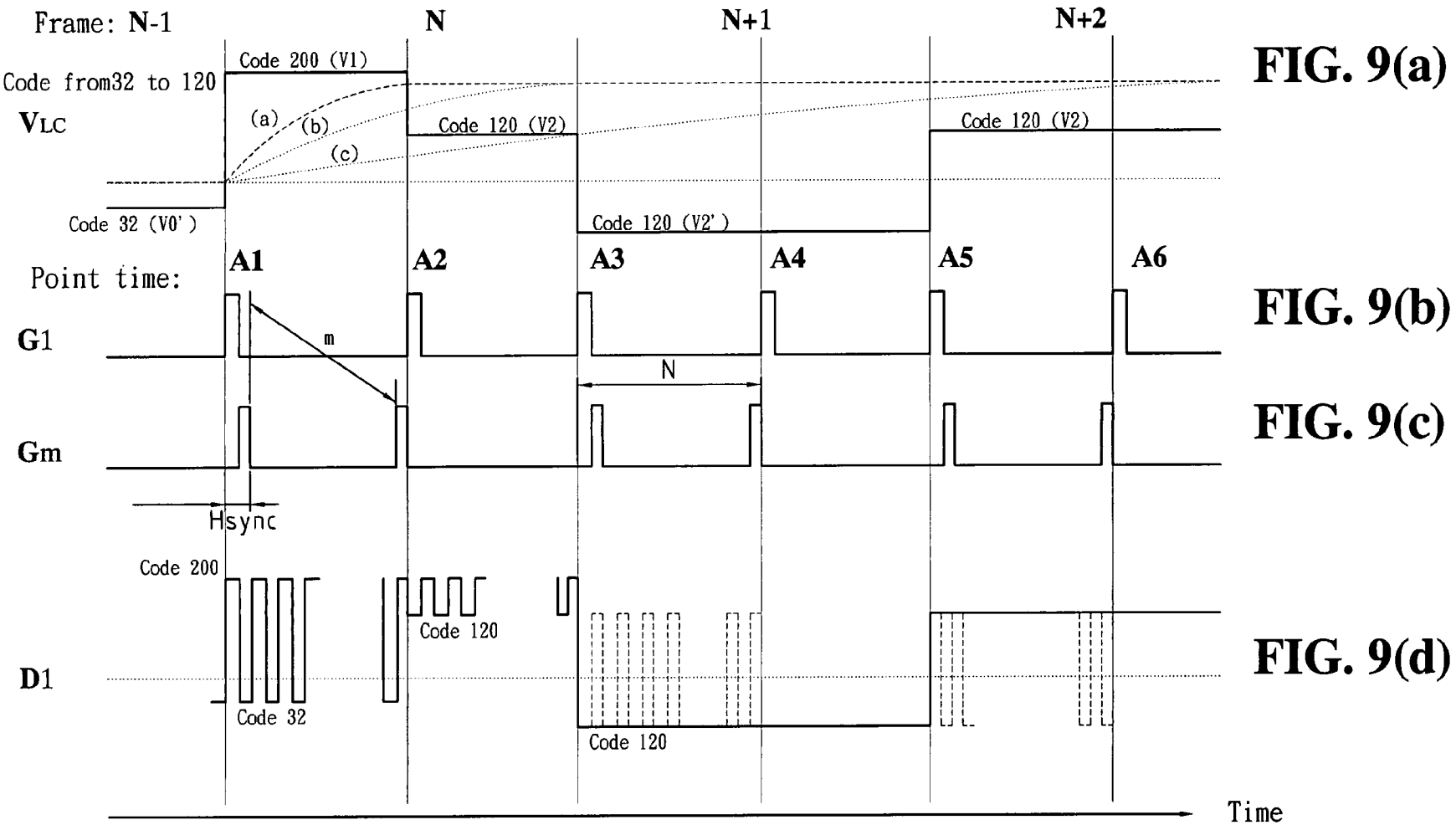
FIGS. 9(*a*) through 9(*d*) shows the various waveforms of the output overdrive voltage $V_{LC}$, the control voltages asserted on the first and second gate lines G1 and Gm, the driving voltages applied on the first data line D1 of FIGS. 8(*a*) and 8(*b*) respectively.

FIGS. 9(*a*) through 9(*d*) show the various waveforms of the output overdrive voltage $V_{LC}$, the control voltages asserted on the first and second gate lines G1 and Gm, the driving voltage applied on the first data line D1 of FIGS. 8(*a*) and 8(*b*) respectively.

Driving Method of the Third Embodiment of the Present Invention

The driving method of the overdrive device according to the third embodiment of the present invention comprises the following steps:

(a) providing a first driving voltage D1 having a periodical pulse waveform as shown in FIG. 9(*d*) to the sources of the first and second transistors Q1 and Qm, (b) providing OE and STH signals to the two gate drivers connecting the first and second gate lines so that a first and second control voltages G1 and Gm as shown in FIGS. 9(*b*) and 9(*c*) are applied to the gates of the first and second transistors Q1 and Qm, and (c) delivering the output overdrive voltage $V_{LC}$ formed by the first driving voltage D1 through the output lines of the first and second transistors Q1 and Qm when they are triggered by the control voltages to corresponding pixels of the LCD display so that the pixels reach a targeted optical response.

Waveform Analysis of the Third Embodiment of the Present Invention

Because alternating current (AC) voltage is used to drive the overdrive device, the driving voltage generated by the overdrive device as shown in FIG. 9(*d*) and the output overdrive voltage $V_{LC}$ alternate between positive and negative phases with respect to the reference voltage Vcom.

During the frame N−1 and before the instant A1, the driving voltage D1 and the output overdrive voltage $V_{LC}$ are at a negative V0' (code 32). Then after the instant A1 and during frame N, the driving voltage D1 jumps instantaneously to a positive V1 (code 200). Due to the control voltage G1's trigger at the instant A1, the output overdrive voltage $V_{LC}$ jumps to the positive V1 (code 200) and remains at V1 until the instant A2. At the instant A2, the driving voltage D1 is at a positive V2 (code 120). Due to the trigger of the control voltage G1 at the instant A2, the output overdrive voltage $V_{LC}$ drops from the positive V1 (code 200) to the positive V2 (code 120) and remains at V2 until the instant A3. Frame N+1 starts from the instant A3. At this point of time, the driving voltage D1 drops instantaneously to a negative V2' (code 120). Due to the control voltage G1's trigger at the instant A3, the output overdrive voltage $V_{LC}$ drops instantaneously to the negative V2' (code 120) and remains at V2' until the instant A4. At the instant A4, the driving voltage D1' is still at the negative V2' (code 120). Due to the trigger of the control voltage G1' at the instant A4, the output overdrive voltage $V_{LC}$ is maintained at the negative V2' (code 120) until the instant A5. Frame N+2 starts from the instant A5. At this point of time, the driving voltage D1 jumps instantaneously to a positive V2 (code 120). Due to the control voltage G1's trigger at the instant A5, the output overdrive voltage $V_{LC}$ jumps instantaneously to the positive V2 (code 120) as well and remains at V2 until the instant A6. What happens at and after the instant A6 can be easily deduced from the foregoing description.

As shown in FIG. 9(*a*), the curve (c) is the liquid crystal optical response trajectory when no overdrive is applied. The curve (b) is the liquid crystal optical response trajectory under overdrive and the frame time is 16 ms. The curve (a) is the liquid crystal optical response trajectory under overdrive and the frame time is 5 ms.

The "Hsync" shown in FIG. 9(*c*) means the control voltages G1 and Gm are synchronized. Accordingly, based on the third embodiment of the present invention, the first and second control voltages G1 and Gm are applied synchronously to two gate lines that are m−1 lines apart on the LCD display. The interaction between the control voltage Gm, the driving voltage D1, and the output overdrive voltage $V_{LC}$ are exactly the same as that between the control voltage G1, the driving voltage D1, and the output overdrive voltage $V_{LC}$ (as depicted from FIG. 9(*a*) to FIG. 9(*d*)). Further description is therefore omitted.

The output overdrive voltage $V_{LC}$ generated by the overdrive device according the third embodiment of the present invention is the same as the one generated by the first embodiment of the present invention. This is intended to simply the explanation and comparison of the embodiments of the present invention. The designer, however, can actually, based on the principle of the present invention, to generate the output overdrive voltage $V_{LC}$ having a specific waveform to suit the designer's requirement.

Please be noted that, the output overdrive voltage $V_{LC}$ can achieve the objective and effect of overdriving liquid crystal whether the output overdrive voltage $V_{LC}$ have either a positive or negative polarity.

In addition, the m-line distance between the first and second gate lines can be adjusted based on the actual requirement and targeted effect. This important feature of the present invention is not known to or available from the prior arts.

Fourth Embodiment of the Present Invention

Figures 10A, 10B:
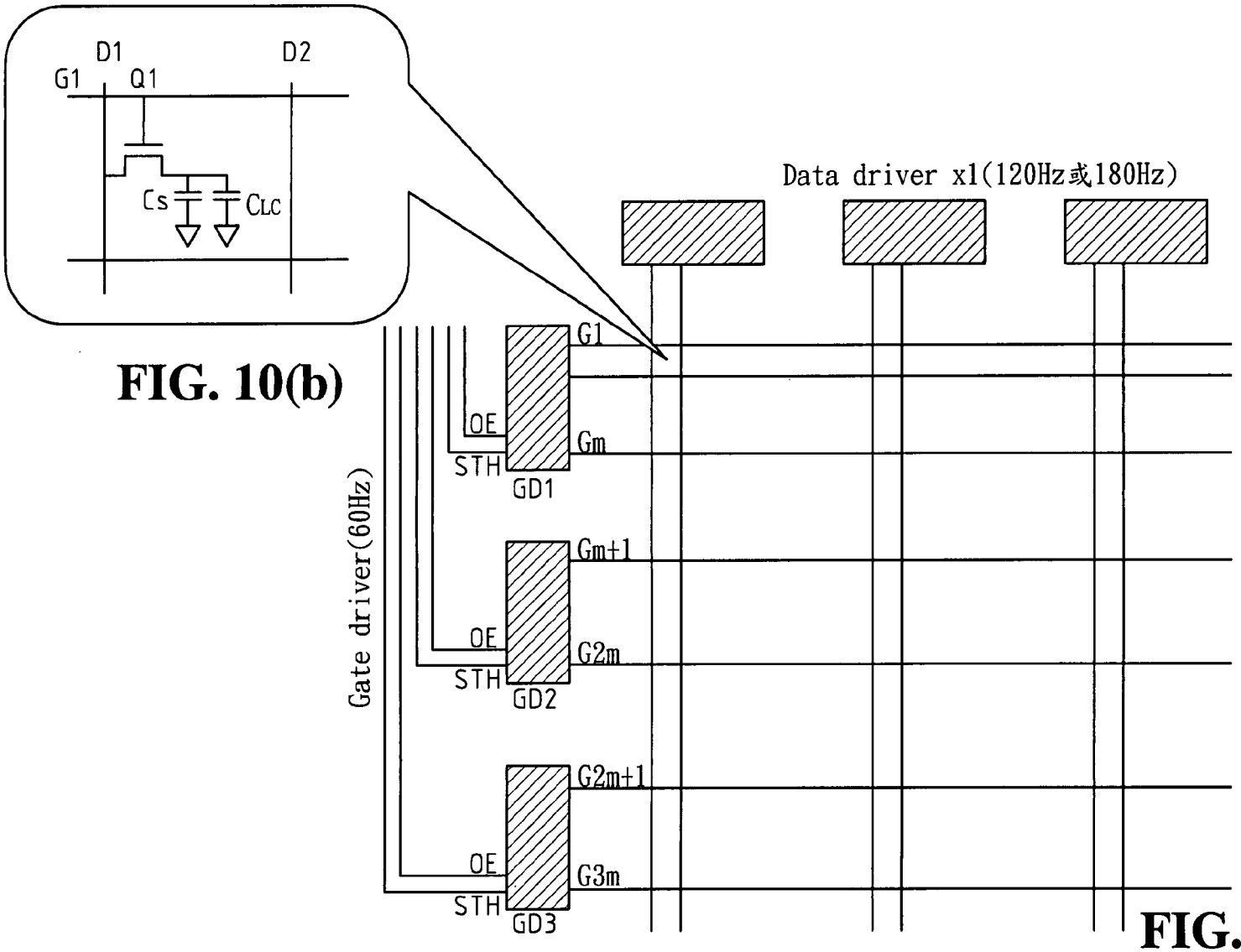
FIGS. 10(*a*) and 10(*b*) are schematic diagrams showing the overdrive device and an inner structure of a pixel at the intersection of a plurality of gate lines and data lines according to the fourth embodiment of the present invention.

The fourth embodiment of the present invention is described in the following along with FIGS. 10(*a*) and 10(*b*) and FIGS. 11(*a*) to 11(*e*). The fifth embodiment of the present invention also adopts the identical overdrive device as depicted in FIGS. 10(*a*) and 10(*b*). However, a different driving method is applied in the fifth embodiment of the present invention to achieve a different display effect. More details will be given later.

FIGS. 10(*a*) and 10(*b*) are schematic diagrams showing the overdrive device and an inner structure of a pixel at the intersection of a plurality of gate lines and data lines according to the fourth embodiment of the present invention.

Driving Device of the Fourth Embodiment of the Present Invention

As shown in FIG. 10(*b*), the pixel structure of the overdrive device according to the present invention comprises a firs gate line G1, a first data line D1, a first capacitor Cs connected to the ground as a storage capacitor, a second capacitor $C_{LC}$ also connected to the ground representing the equivalent capacitance of liquid crystal, an output line (not shown in FIG. 10(*b*)) for delivering the output overdrive voltage ($V_{LC}$) to a corresponding pixel on the LCD display, a first transistor Q1 having its gate connected to the first gate line G1, its source connected to the first data line D1, and its drain connected to the output line, the first capacitor Cs, and the second capacitor $C_{LC}$. As shown in FIG. 10(*a*), the first gate line G1 is connected to a gate driver and the first data line D1 is connected to a data driver. Each of the gate drivers has two input lines, the Output Enable (OE) and Start Pulse Horizontal (STH) lines. The OE and STH input lines control the gate drivers so that two of the three gate drivers GD1, GD2, and GD3 are enabled simultaneously at a time and the two enabled gate drivers alternate in pairs such as GD1 and GD3 together, and then GD1 and GD2 together, and then GD2 and GD3 together, all within a single frame time. Then at the next frame time, the gate drivers GD1 and GD3 are enabled together again. The pattern will repeat like this continuously. Each gate driver controls up to m gate lines. When gate drivers GD1 and GD3 are enabled, the gate drivers GD1 and GD3 apply control voltages on the gate lines G1 and G2*m*+1 synchronously, and then on the gate lines G2 and G2*m*+2, until on the gate lines Gm and G3*m*. Then gate drivers GD1 and GD2 are enabled. When gate drivers GD1 and GD2 are enabled, the gate driver GD1 and GD2 apply control voltages on the gate lines G1 and Gm+1 synchronously, and then on the gate lines G2 and Gm+2, until on the gate lines Gm and G2*m*. The pattern repeats like this continuously. When the pulse of the control voltage is applied on a gate line, the transistor of each pixel that has its gate connected to the gate line is triggered so that the driving voltages of these pixels apply to the pixels via their output lines and a line of the image is thereby displayed. According to the fourth embodiment of the present invention, two lines of the image are displayed simultaneously on the LCD display.

Figures 11A, 11B, 11C, 11D, 11E:
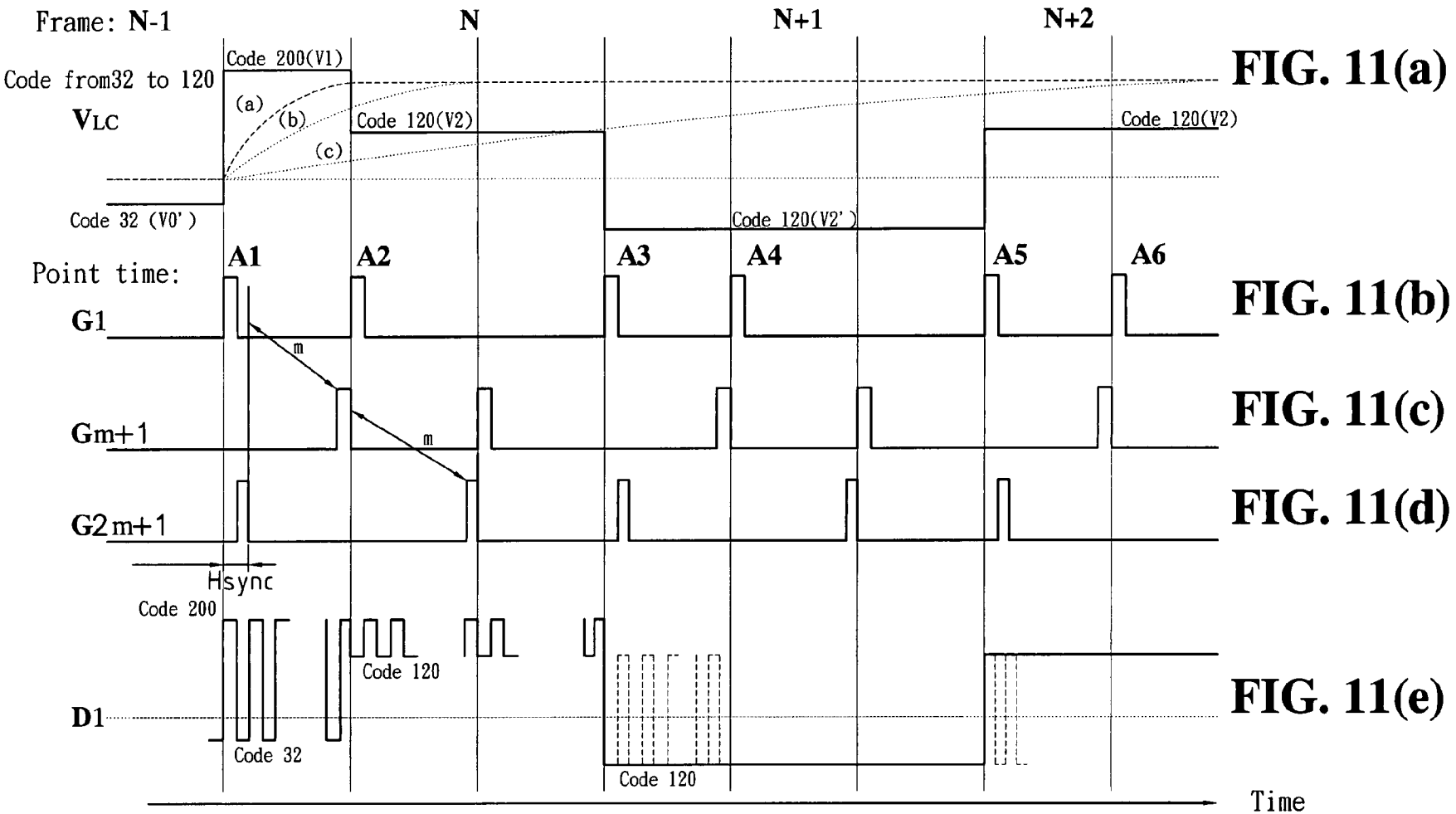
FIGS. 11(*a*) through 11(*e*) shows the various waveforms of the output overdrive voltage $V_{LC}$, the control voltages asserted on the first, second, and third gate lines G1, Gm+1, and G2*m*+1, the driving voltages applied on the first data line D1 of FIGS. 10(*a*) and 10(*b*) respectively.

FIGS. 11(*a*) through 11(*e*) show the various waveforms of the output overdrive voltage $V_{LC}$, the control voltages asserted on the first, second, and third gate lines G1, Gm+1, and G2*m*+1, the driving voltage applied on the first data line D1 of FIGS. 10(*a*) and 10(*b*) respectively.

Driving Method of the Fourth Embodiment of the Present Invention

The driving method of the overdrive device according to the fourth embodiment of the present invention comprises the following steps:

(a) providing a first driving voltage D1 having a periodical pulse waveform as shown in FIG. 11(*e*) to the sources of the first transistors Q1, (b) providing the OE and STH signals to the gate drivers so that two of the three gate drivers GD1, GD2, and GD3 are enabled simultaneously at a time and the two enabled gate drivers alternate repeatedly in pairs such as GD1 and GD3 together, and then GD1 and GD2 together, and then GD2 and GD3 together in a single frame time, (c) providing control voltages from the two enabled gate drivers synchronously on two gate lines that are 2m lines apart and each of which is connected to one of the gate drivers respectively, and (d) delivering the output overdrive voltages $V_{LC}$ formed by the driving voltages through the output lines of the transistors that have their gates connected to the two gate lines when they are triggered by the control voltages to corresponding pixels of the LCD display so that the pixels reach a targeted optical response.

Waveform Analysis of the Fourth Embodiment of the Present Invention

Because alternating current (AC) voltage is used to drive the overdrive device, the driving voltage generated by the overdrive device as shown in FIG. 11(*e*) and the output overdrive voltage $V_{LC}$ alternate between positive and negative phases with respect to the reference voltage Vcom.

During the frame N−1 and before the instant A1, the driving voltage D1 and the output overdrive voltage $V_{LC}$ are at a negative V0' (code 32). Then after the instant A1 and during frame N, the driving voltage D1 jumps instantaneously to a positive V1 (code 200). Due to the control voltage G1's trigger at the instant A1, the output overdrive voltage $V_{LC}$ jumps to the positive V1 (code 200) and remains at V1 until the instant A2. At the instant A2, the driving voltage D1 is at a positive V2 (code 120). Due to the trigger of the control voltage G1 at the instant A2, the output overdrive voltage $V_{LC}$ drops from the positive V1 (code 200) to the positive V2 (code 120) and remains at V2 until the instant A3. Frame N+1 starts from the instant A3. At this point of time, the driving voltage D1 drops instantaneously to a negative V2' (code 120). Due to the control voltage G1's trigger at the instant A3, the output overdrive voltage $V_{LC}$ drops instantaneously to the negative V2' (code 120) and remains at V2' until the instant A4. At the instant A4, the driving voltage D1' is still at the negative V2' (code 120). Due to the trigger of the control voltage G1' at the instant A4, the output overdrive voltage $V_{LC}$ is maintained at the negative V2' (code 120) until the instant A5. Frame N+2 starts from the instant A5. At this point of time, the driving voltage D1 jumps instantaneously to a positive V2 (code 120). Due to the control voltage G1's trigger at the instant A5, the output overdrive voltage $V_{LC}$ jumps instantaneously to the positive V2 (code 120) as well and remains at V2 until the instant A6. What happens at and after the instant A6 can be easily deduced from the foregoing description.

As shown in FIG. 11(*a*), the curve (c) is the liquid crystal optical response trajectory when no overdrive is applied.

The curve (b) is the liquid crystal optical response trajectory under overdrive and the frame time is 16 ms. The curve (a) is the liquid crystal optical response trajectory under overdrive and the frame time is 5 ms.

In summary, the objective of the fourth embodiment of the present invention is that two lines of pixels that are 2m lines apart are displayed simultaneously and synchronously on the LCD display as shown in FIGS. 11(*b*) through 11(*d*).

The interaction between the control voltages Gm+1 and G2*m*+1, the driving voltage D1, and the output overdrive voltage $V_{LC}$ are exactly the same as that between the control voltage G1, the driving voltage D1, and the output overdrive voltage $V_{LC}$ (as depicted in FIGS. 11(*a*), 11(*b*), and 11(*e*)). Further description is therefore omitted.

The output overdrive voltage $V_{LC}$ generated by the overdrive device according the fourth embodiment of the present invention is the same as the one generated by the first embodiment of the present invention. This is intended to simply the explanation and comparison of the embodiments of the present invention. The designer, however, can actually, based on the principle of the present invention, to generate the output overdrive voltage $V_{LC}$ having a specific waveform to suit the designer's requirement.

Fifth Embodiment of the Present Invention

The fifth embodiment of the present invention is described in the following along with FIGS. 10(*a*) and 10(*b*) and FIGS. 12(*a*) to 12(*e*). The fifth embodiment of the present invention adopts the identical overdrive device as the fourth embodiment of the present invention as depicted in FIGS. 10(*a*) and 10(*b*). However, a different driving method is applied in the fifth embodiment of the present invention to achieve a different display effect.

FIGS. 10(*a*) and 10(*b*) are schematic diagrams showing the overdrive device and an inner structure of a pixel at the intersection of a plurality of gate lines and data lines according to the fourth embodiment of the present invention.

Driving Device of the Fifth Embodiment of the Present Invention

As shown in FIG. 10(*b*), the pixel structure of the overdrive device according to the present invention comprises a firs gate line G1, a first data line D1, a first capacitor Cs connected to the ground as a storage capacitor, a second capacitor $C_{LC}$ also connected to the ground representing the equivalent capacitance of liquid crystal, an output line (not shown in FIG. 10(*b*)) for delivering the output overdrive voltage ($V_{LC}$) to a corresponding pixel on the LCD display, a first transistor Q1 having its gate connected to the first gate line G1, its source connected to the first data line D1, and its drain connected to the output line, the first capacitor Cs, and the second capacitor $C_{LC}$. As shown in FIG. 10(*a*), the first gate line G1 is connected to a gate driver and the first data line D1 is connected to a data driver. Each of the gate drivers has two input lines, the Output Enable (OE) and Start Pulse Horizontal (STH) lines. The OE and STH input lines control the gate drivers so that the three gate drivers GD1, GD2, and GD3 are enabled simultaneously at a time. Each gate driver controls up to m gate lines. When gate drivers GD1, GD2, and GD3 are enabled, the gate drivers GD1, GS2, and GD3 apply control voltages on the gate lines G1, Gm+1, and G2*m*+1 synchronously, and then on the gate lines G2, Gm+2, and G2*m*+2, until on the gate lines Gm, G2*m*, and G3*m*. When the pulse of the control voltage is applied on a gate line, the transistor of each pixel that has its gate connected to the gate line is triggered so that the driving voltages of these pixels apply to the pixels via their output lines and a line of the image is thereby displayed. According to the fifth embodiment of the present invention, three lines of the image that are m lines apart are displayed simultaneously on the LCD display.

Figures 12A, 12B, 12C, 12D, 12E:
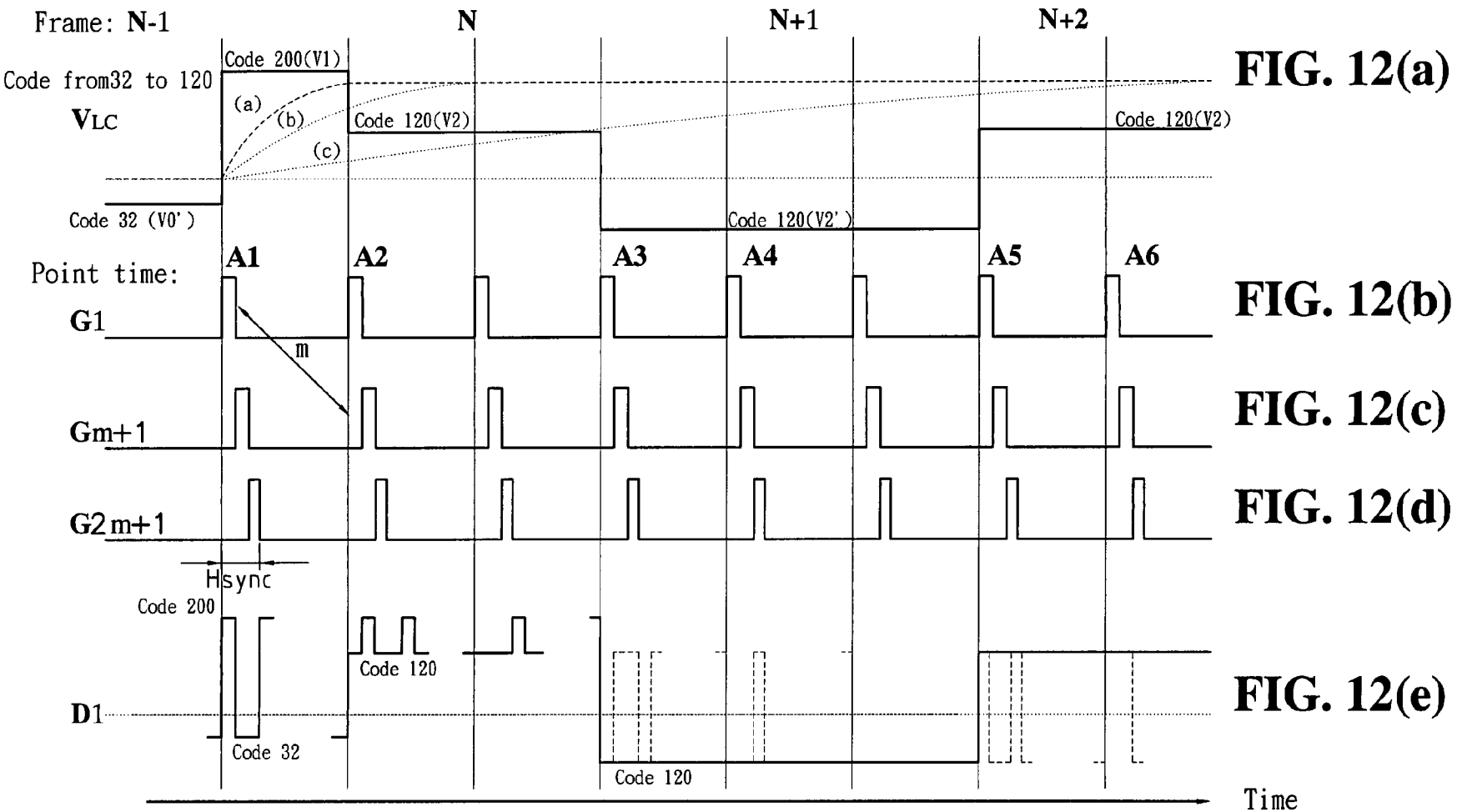
FIGS. 12(*a*) through 12(*e*) shows the various waveforms of the output overdrive voltage $V_{LC}$, the control voltages asserted on the first, second, and third gate lines G1, Gm+1, and G2*m*+1, the driving voltages applied on the first data line D1 of FIGS. 10(*a*) and 10(*b*) respectively.

FIGS. 12(*a*) through 12(*e*) show the various waveforms of the output overdrive voltage $V_{LC}$, the control voltages asserted on the first, second, and third gate lines G1, Gm+1, and G2*m*+1, the driving voltage applied on the first data line D1 of FIGS. 10(*a*) and 10(*b*) respectively.

Driving Method of the Fifth Embodiment of the Present Invention

The driving method of the overdrive device according to the fifth embodiment of the present invention comprises the following steps:

(a) providing a first driving voltage D1 having a periodical pulse waveform as shown in FIG. 12(*e*) to the sources of the first transistors Q1, (b) providing the OE and STH signals to the gate drivers so that the three gate drivers GD1, GD2, and GD3 are enabled simultaneously, (c) providing control voltages from the gate drivers synchronously on three gate lines that are m lines apart and each of which is connected to one of the gate drivers respectively, and (d) delivering the output overdrive voltages $V_{LC}$ formed by the driving voltages through the output lines of the transistors that have their gates connected to the three gate lines when they are triggered by the control voltages to corresponding pixels of the LCD display so that the pixels reach a targeted optical response.

Waveform Analysis of the Fifth Embodiment of the Present Invention

Because alternating current (AC) voltage is used to drive the overdrive device, the driving voltage generated by the overdrive device as shown in FIG. 12(*e*) and the output overdrive voltage $V_{LC}$ alternate between positive and negative phases with respect to the reference voltage Vcom.

During the frame N−1 and before the instant A1, the driving voltage D1 and the output overdrive voltage $V_{LC}$ are at a negative V0' (code 32). Then after the instant A1 and during frame N, the driving voltage D1 jumps instantaneously to a positive V1 (code 200). Due to the control voltage G1's trigger at the instant A1, the output overdrive voltage $V_{LC}$ jumps to the positive V1 (code 200) and remains at V1 until the instant A2. At the instant A2, the driving voltage D1 is at a positive V2 (code 120). Due to the trigger of the control voltage G1 at the instant A2, the output overdrive voltage $V_{LC}$ drops from the positive V1 (code 200) to the positive V2 (code 120) and remains at V2 until the instant A3. Frame N+1 starts from the instant A3. At this point of time, the driving voltage D1 drops instantaneously to a negative V2' (code 120). Due to the control voltage G1's trigger at the instant A3, the output overdrive voltage $V_{LC}$ drops instantaneously to the negative V2' (code 120) and remains at V2' until the instant A4. At the instant A4, the driving voltage D1' is still at the negative V2' (code 120). Due to the trigger of the control voltage G1' at the instant A4, the output overdrive voltage $V_{LC}$ is maintained at the negative V2' (code 120) until the instant A5. Frame N+2 starts from the instant A5. At this point of time, the driving voltage D1 jumps instantaneously to a positive V2 (code 120). Due to the control voltage G1's trigger at the instant A5, the output overdrive voltage $V_{LC}$ jumps instantaneously to the positive V2 (code 120) as well and remains at V2 until the instant A6. What happens at and after the instant A6 can be easily deduced from the foregoing description.

As shown in FIG. 12(*a*), the curve (c) is the liquid crystal optical response trajectory when no overdrive is applied. The curve (b) is the liquid crystal optical response trajectory under overdrive and the frame time is 16 ms. The curve (a) is the liquid crystal optical response trajectory under overdrive and the frame time is 5 ms.

In summary, the objective of the fifth embodiment of the present invention is that three lines of pixels that are m lines apart are displayed simultaneously and synchronously on the LCD display as shown in FIGS. 12(*b*) through 12(*d*).

The interaction between the control voltages Gm+1 and G2*m*+1, the driving voltage D1, and the output overdrive voltage $V_{LC}$ are exactly the same as that between the control voltage G1, the driving voltage D1, and the output overdrive voltage $V_{LC}$ (as depicted in FIGS. 12(*a*), 12(*b*), and 12(*e*)). Further description is therefore omitted.

According to the fifth embodiment of the present invention, each line of image will be displayed three times in a single frame time. Each line of the image will be displayed with two other lines that are m lines apart simultaneously.

The output overdrive voltage $V_{LC}$ generated by the overdrive device according the fifth embodiment of the present invention is the same as the one generated by the first embodiment of the present invention. This is intended to simply the explanation and comparison of the embodiments of the present invention. The designer, however, can actually, based on the principle of the present invention, to generate the output overdrive voltage $V_{LC}$ having a specific waveform to suit the designer's requirement.

From the foregoing detailed description of the five embodiments of the present invention, it is apparent that the present invention indeed offers design and manufacturing flexibility. For example, the time interval n between the first and second control voltages G1 and G1' of the first and second embodiments is adjustable. Similarly, the distance m between the synchronously displayed image lines of the fourth and fifth embodiments is also adjustable. Such design flexibility allows the designers of LCD display to achieve the optimal optical response from the LCD displays implemented with the overdrive device and method of the present invention.

Accordingly, the method and device for overdriving the LCD display provided by the present invention can indeed improve and overcome the limitations and disadvantages of prior arts. The LCD displays employing the present invention therefore have faster optical response time and superior dynamic image display quality.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A device for overdriving an LCD display comprising a first gate line; a second gate line; a first data line; a second data line;

an output line delivering an output overdrive voltage to the a corresponding pixel on said LCD display;

a first capacitor connected to ground as a storage capacitor;

a second capacitor connected to ground representing an equivalent capacitance of said pixel;

a first transistor having its gate connected to said first gate line, its source connected to said first data line, and its drain connected to said output line, said first capacitor and a drain of a second transistor;

a second transistor having its gate connected to said second gate line, its source connected to said second data line, and its drain connected to a drain of said first transistor, said second capacitor, and said output line, wherein said first and second gate lines are connected to a gate driver, said first and second data lines are connected to a data driver, and control voltages on said first and second gate lines have identical periodical pulse waveforms with a time difference of n pulses where n is adjustable.

2. A method for overdriving an LCD display comprising the steps of:

providing a circuit comprising a first gate line, a second gate line, a first data line, a second data line, a first transistor, a second transistor, a first capacitor, a second capacitor, and an output line;

applying a first control voltage having a periodical pulse waveform on a gate of said first transistor;

applying a second control voltage having an identical periodical pulse waveform but lagging behind said first control voltage on a gate of said second transistor;

applying a first driving voltage on a source of said first transistor that delivers said first driving voltage to said output line when said first transistor is triggered by said first control voltage;

applying a second driving voltage on a source of said second transistor which delivers said second driving voltage to said output line when said second transistor is triggered by said second periodical voltage, and delivering an output overdrive voltage formed by said first and second driving voltages through said output line to a corresponding pixel of said LCD display so that said pixel reaches a targeted optical response.

3. The method for overdriving an LCD display according to claim 2, wherein said control voltage and said driving voltage are driven by a alternating current (AC) voltage and therefore switch between positive and negative phases, wherein said control voltage and said driving voltage have a repeating pattern comprising the stages of:

(a) a driving voltage D1 and an output overdrive voltage $V_{LC}$ at a negative V0' before an instant A1 and during a frame N−1;

(b) said driving voltage D1 jumping instantaneously to a positive V1 at an instant A1 and, due to a control voltage G1's trigger, said output overdrive voltage $V_{LC}$ jumping to said positive V1 and remaining at V1 until an instant A2 during a frame N;

(c) a driving voltage D1' staying at a positive V2 (V2<V1) at said instant A2 and, due to a trigger of said control voltage G1', said output overdrive voltage $V_{LC}$ dropping to said positive V2 and remaining at V2 until an instant A3 during said frame N;

(d) said driving voltage D1 dropping instantaneously to a negative V2' at said instant A3 and, due to said control voltage G1's trigger, said output overdrive voltage $V_{LC}$ dropping to said negative V2' and remaining at V2' until an instant A4 during said frame N+1;

(e) said driving voltage D1' being at said negative V2' at said instant A4 and, due to a trigger of said control voltage G1', said output overdrive voltage $V_{LC}$ staying at said negative V2' until an instant A5 during said frame N+1; and (f) said driving voltage D1 jumping instantaneously to a positive V2 at said instant A5 and, due to said control voltage G1's trigger, said output overdrive voltage $V_{LC}$ jumping to said positive V2 and remaining at V2 until an instant A6 during said frame N+2.

4. A device for overdriving an LCD display comprising:

a first gate line; a second gate line; a first data line; a second data line; a third data line; a fourth data line; a fifth data line;

an output line delivering an output overdrive voltage to the a corresponding pixel on said LCD display;

a first capacitor connected to ground as a storage capacitor;

a second capacitor connected to ground representing an equivalent capacitance of said pixel;

a first transistor having its gate connected to said first gate line, its source connected to said first data line, and its drain connected to said output line, said first capacitor and a drain of a second transistor;

a second transistor having its gate connected to said second gate line, its source connected to said second data line, and its drain connected to a drain of said first transistor, said second capacitor, and said output line; and a third and fourth transistors having their sources parallel connected to a data driver via said fifth data line, their gates connected to said third and fourth data lines respectively; wherein said first and second gate lines are connected to a gate driver, said first and second data lines are connected to drains of said fourth and third transistor respectively, said first and second data lines are connected to a data driver, and control voltages on said first and second gate lines have identical periodical pulse waveforms with a time difference of n pulses where n is adjustable.

5. A method for overdriving an LCD display comprising the steps of:

providing a circuit comprising a fist gate line, a second gate line, a first data line, a second data line, a third data line, a fourth data line, a fifth data line, a first transistor, a second transistor, a third transistor, a fourth transistor, a first capacitor, a second capacitor, and an output line;

applying a first control voltage having a periodical pulse waveform on a gate of said first transistor;

applying a second control voltage having an identical periodical pulse waveform but lagging behind said first control voltage on a gate of said second transistor;

applying a fifth driving voltage on sources of parallel-connected third and fourth transistor;

applying a third driving voltage on a gate of said third transistor, generating a first driving voltage from a drain of said third transistor, applying said first driving voltage on a source of said first transistor, and delivering said first driving voltage to said output line when said first transistor is triggered by said first control voltage;

applying a fourth driving voltage on a gate of said fourth transistor, generating a second driving voltage from a drain of said fourth transistor, applying said second driving voltage on a source of said second transistor, and delivering said second driving voltage to said output line when said second transistor is triggered by said second control voltage; and delivering an output overdrive voltage formed by foregoing driving voltages through said output line to a corresponding pixel of said LCD display so that said pixel reaches a targeted optical response.

6. The method for overdriving an LCD display according to claim 5, wherein said control voltage and said driving voltage are driven by a alternating current (AC) voltage and therefore switch between positive and negative phases, wherein said control voltage and said driving voltage have a repeating pattern comprising the stages of:

(a) a driving voltage D1 and an output overdrive voltage $V_{LC}$ at a negative V0' before an instant A1 and during a frame N−1;

(b) said driving voltage D1 jumping instantaneously to a positive V1 at an instant A1 and, due to a control voltage G1's trigger, said output overdrive voltage $V_{LC}$ jumping to said positive V1 and remaining at V1 until an instant A2 during a frame N;

(c) a driving voltage D1' staying at a positive V2 (V2<V1) at said instant A2 and, due to a trigger of said control voltage G1', said output overdrive voltage $V_{LC}$ dropping to said positive V2 and remaining at V2 until an instant A3 during said frame N;

(d) said driving voltage D1 dropping instantaneously to a negative V2' at said instant A3 and, due to said control voltage G1's trigger, said output overdrive voltage $V_{LC}$ dropping to said negative V2' and remaining at V2' until an instant A4 during said frame N+1;

(e) said driving voltage D1' being at said negative V2' at said instant A4 and, due to a trigger of said control voltage G1', said output overdrive voltage $V_{LC}$ staying at said negative V2' until an instant A5 during said frame N+1; and (f) said driving voltage D1 jumping instantaneously to a positive V2 at said instant A5 and, due to said control voltage G1's trigger, said output overdrive voltage $V_{LC}$ jumping to said positive V2 and remaining at V2 until an instant A6 during said frame N+2.

7. A device for overdriving an LCD display comprising a gate line; a data line;

an output line delivering an output overdrive voltage to the a corresponding pixel on said LCD display;

a first capacitor connected to ground as a storage capacitor;

a second capacitor connected to ground representing an equivalent capacitance of said pixel; and a transistor having its gate connected to said gate line, its source connected to said data line, and its drain connected to said output line, said first capacitor and said second capacitor; wherein said gate line is connected to a gate driver, said data line is connected to a data driver, and an Output Enable (OE) and a Start Pulse Horizontal (STH) control signal are connected to each of said gate drivers and control said gate drivers to apply control voltages on two gate lines that are m lines apart synchronously so that two lines of image are displayed simultaneously.

8. A method for overdriving an LCD display comprising the steps of:

providing a circuit comprising a gate line, a data line, a transistor, a first capacitor, a second capacitor, and an output line;

applying a driving voltage having a periodical pulse waveform on a source of said transistor;

applying an OE and a STH control signal to said gate driver so that said gate driver generates synchronous control voltages G1 and Gm to a gate of said transistor;

applying said driving voltage to said output line when triggered by said control voltages G1 and Gm; and delivering an output overdrive voltage formed by foregoing driving voltages through said output line to a corresponding pixel of said LCD display so that said pixel reaches a targeted optical response.

9. The method for overdriving an LCD display according to claim 8, wherein said control voltage and said driving voltage are driven by a alternating current (AC) voltage and therefore switch between positive and negative phases, wherein said control voltage and said driving voltage have a repeating pattern comprising the stages of:

(a) a driving voltage D1 and an output overdrive voltage $V_{LC}$ at a negative V0' before an instant A1 and during a frame N−1;

(b) said driving voltage D1 jumping instantaneously to a positive V1 at an instant A1 and, due to a control voltage G1's trigger, said output overdrive voltage $V_{LC}$ jumping to said positive V1 and remaining at V1 until an instant A2 during a frame N;

(c) said driving voltage D1 dropping to a positive V2 (V2<V1) at said instant A2 and, due to said control voltage G1's trigger, said output overdrive voltage $V_{LC}$ dropping to said positive V2 and remaining at V2 until an instant A3 during said frame N;

(d) said driving voltage D1 dropping instantaneously to a negative V2' at said instant A3 and, due to said control voltage G1's trigger, said output overdrive voltage $V_{LC}$ dropping to said negative V2' and remaining at V2' until an instant A4 during said frame N+1;

(e) said driving voltage D1 being at said negative V2' at said instant A4 and, due to said control voltage G1's trigger, said output overdrive voltage $V_{LC}$ staying at said negative V2' until an instant A5 during said frame N+1; and (f) said driving voltage D1 jumping instantaneously to a positive V2 at said instant A5 and, due to said control voltage G1's trigger, said output overdrive voltage $V_{LC}$ jumping to said positive V2 and remaining at V2 until an instant A6 during said frame N+2.

10. A device for overdriving an LCD display comprising a gate line;

a data line;

an output line delivering an output overdrive voltage to the a corresponding pixel on said LCD display;

a first capacitor connected to ground as a storage capacitor;

a second capacitor connected to ground representing an equivalent capacitance of said pixel; and a transistor having its gate connected to said gate line, its source connected to said data line, and its drain connected to said output line, said first capacitor and said second capacitor; wherein said gate line is connected to one of three gate driver, said data line is connected to a data driver, and an Output Enable (OE) and a Start Pulse Horizontal (STH) control signal are connected to each of said three gate drivers and control said gate drivers to enable two out of said three gate drivers simultaneously and to apply control voltages on two gate lines that are 2m lines apart so that two lines of image are displayed simultaneously.

11. A method for overdriving an LCD display comprising the steps of:

providing a circuit comprising a first gate line, a second gate line, a third gate line, a data line, a transistor, a first capacitor, a second capacitor, and an output line;

applying a driving voltage having a periodical pulse waveform on a source of said transistor;

applying OE and STH control signals to three gate drivers and controlling said gate drivers to enable two out of said three gate drivers simultaneously so that said enabled gate drivers apply control voltages on two gate lines that are 2m lines apart; and delivering an output overdrive voltage formed by foregoing driving voltages through said output line to a corresponding pixel of said LCD display so that said pixel reaches a targeted optical response.

12. The method for overdriving an LCD display according to claim 11, wherein said control voltage and said driving voltage are driven by a alternating current (AC) voltage and therefore switch between positive and negative phases, wherein said control voltage and said driving voltage have a repeating pattern comprising the stages of:

(a) a driving voltage D1 and an output overdrive voltage $V_{LC}$ at a negative V0' before an instant A1 and during a frame N−1;

(b) said driving voltage D1 jumping instantaneously to a positive V1 at an instant A1 and, due to a control voltage G1's trigger, said output overdrive voltage $V_{LC}$ jumping to said positive V1 and remaining at V1 until an instant A2 during a frame N;

(c) said driving voltage D1 dropping to a positive V2 (V2<V1) at said instant A2 and, due to said control voltage G1's trigger, said output overdrive voltage $V_{LC}$ dropping to said positive V2 and remaining at V2 until an instant A3 during said frame N;

(d) said driving voltage D1 dropping instantaneously to a negative V2' at said instant A3 and, due to said control voltage G1's trigger, said output overdrive voltage $V_{LC}$ dropping to said negative V2' and remaining at V2' until an instant A4 during said frame N+1;

(e) said driving voltage D1 being at said negative V2' at said instant A4 and, due to said control voltage G1's trigger, said output overdrive voltage $V_{LC}$ staying at said negative V2' until an instant A5 during said frame N+1; and (f) said driving voltage D1 jumping instantaneously to a positive V2 at said instant A5 and, due to said control voltage G1's trigger, said output overdrive voltage $V_{LC}$ jumping to said positive V2 and remaining at V2 until an instant A6 during said frame N+2.

13. A device for overdriving an LCD display comprising a gate line; a data line;

an output line delivering an output overdrive voltage to the a corresponding pixel on said LCD display;

a first capacitor connected to ground as a storage capacitor;

a second capacitor connected to ground representing an equivalent capacitance of said pixel; and a transistor having its gate connected to said gate line, its source connected to said data line, and its drain connected to said output line, said first capacitor and said second capacitor; wherein said gate line is connected to one of three gate drivers, said data line is connected to a data driver, and an Output Enable (OE) and a Start Pulse Horizontal (STH) control signal are connected to each of said three gate drivers and control said gate drivers to enable said three gate drivers simultaneously and to apply control voltages on three gate lines that are m lines apart so that three lines of image are displayed simultaneously.

14. A method for overdriving an LCD display comprising the steps of:

providing a circuit comprising a first gate line, a second gate line, a third gate line, a data line, a transistor, a first capacitor, a second capacitor, and an output line;

applying a driving voltage having a periodical pulse waveform on a source of said transistor;

applying OE and STH control signals to three gate drivers and controlling said gate drivers to enable said three gate drivers simultaneously so that said enabled gate drivers apply control voltages on three gate lines that are m lines apart; and delivering an output overdrive voltage formed by foregoing driving voltages through said output line to a corresponding pixel of said LCD display so that said pixel reaches a targeted optical response.

15. The method for overdriving an LCD display according to claim 14, wherein said control voltage and said driving voltage are driven by a alternating current (AC) voltage and therefore switch between positive and negative phases, wherein said control voltage and said driving voltage have a repeating pattern comprising the stages of:

(a) a driving voltage D1 and an output overdrive voltage $V_{LC}$ at a negative V0' before an instant A1 and during a frame N−1;

(b) said driving voltage D1 jumping instantaneously to a positive V1 at an instant A1 and, due to a control voltage G1's trigger, said output overdrive voltage $V_{LC}$ jumping to said positive V1 and remaining at V1 until an instant A2 during a frame N;

(c) said driving voltage D1 dropping to a positive V2 (V2<V1) at said instant A2 and, due to said control voltage G1's trigger, said output overdrive voltage $V_{LC}$ dropping to said positive V2 and remaining at V2 until an instant A3 during said frame N;

(d) said driving voltage D1 dropping instantaneously to a negative V2' at said instant A3 and, due to said control voltage G1's trigger, said output overdrive voltage $V_{LC}$ dropping to said negative V2' and remaining at V2' until an instant A4 during said frame N+1;

(e) said driving voltage D1 being at said negative V2' at said instant A4 and, due to said control voltage G1's trigger, said output overdrive voltage $V_{LC}$ staying at said negative V2' until an instant A5 during said frame N+1; and (f) said driving voltage D1 jumping instantaneously to a positive V2 at said instant A5 and, due to said control voltage G1's trigger, said output overdrive voltage $V_{LC}$ jumping to said positive V2 and remaining at V2 until an instant A6 during said frame N+2.

* * * * *